US005863033A

United States Patent [19]

Bradford

[11] Patent Number: 5,863,033

[45] Date of Patent: Jan. 26, 1999

[54] DUAL-ACTION CLAMP

[76] Inventor: John-Paul Bradford, 6154 Bennington Dr., Newark, Calif. 94560

[21] Appl. No.: 794,777

[22] Filed: Feb. 1, 1997

[51] Int. Cl.[6] ..... B25B 1/00

[52] U.S. Cl. ..... 269/3; 269/6; 269/41; 81/302; 81/421

[58] Field of Search ..... 269/41, 3, 95, 269/143, 149, 6, 1, 140, 249, 254 CS; 81/418, 421, 422, 302

[56] References Cited

U.S. PATENT DOCUMENTS

| | | | |
|---|---|---|---|
| 1,075,384 | 10/1913 | Seidel . | |
| 1,158,242 | 10/1915 | Kyllonen | 81/302 |
| 1,402,621 | 1/1922 | Kesslering . | |
| 1,586,314 | 5/1926 | Kiefer . | |
| 1,788,546 | 1/1931 | Schmieder . | |
| 2,642,905 | 6/1953 | Hewat . | |
| 3,263,535 | 8/1966 | Zurcher | 81/302 |
| 3,429,567 | 2/1969 | Swan . | |
| 4,041,740 | 8/1977 | Villazon | 81/418 |
| 4,088,313 | 5/1978 | Pearson . | |
| 4,114,482 | 9/1978 | Houdeshell | 81/421 |
| 4,176,830 | 12/1979 | Isley | 269/150 |
| 4,696,460 | 9/1987 | Genereaux et al. | 269/41 |
| 4,957,257 | 9/1990 | Gonzalez . | |
| 5,607,344 | 3/1997 | Endres | 269/254 CS |

*Primary Examiner*—David A. Scherbel
*Assistant Examiner*—Lee Wilson
*Attorney, Agent, or Firm*—Gregory Scott Smith

[57] ABSTRACT

A dynamic self-adjusting dual-action clamp comprising a first clamping component defining a plane and generating clamping force along a first clamping axis in that plane, and a second clamping component generating force in a second clamping axis substantially perpendicular to the first clamping axis, but within the same plane as the first clamping axis. The invention further includes elements used to adapt a standard spring actuated pliers-type clamp to convert such clamp to the dual-action clamp described above.

13 Claims, 6 Drawing Sheets

DUAL-ACTION CLAMP

BACKGROUND OF THE INVENTION

1. Field of the Invention

The present invention relates to clamps used to hold work pieces which are to be joined. Specifically, the invention relates to spring clamps having clamping components acting in a single plane along two axes for use in affixing edge pieces to surface pieces such as table and counter tops.

2. Description of the Prior Art

In various industries, but particularly in the laminate industry and in solid surface industries using Corian, Fountainhead, Gibraltar, and Avonite, there has long been a need for clamps to hold edge pieces to be joined to surface pieces for use in fabricating counter tops, tables, and other products. For example, it is often necessary to adhere an edge strip or facing to a counter top or table. Dual-action or compound clamps are useful for holding such pieces, and many dual-action clamps have been developed specifically for such use. Such clamps generally have a first clamping component which clamps in one axis in a plane defined by the clamping component, and a second clamping component which clamps in the same plane but on a different axis from the first clamping component. In use, the first clamping component holds the clamp securely to the surface work piece while the second clamping component, usually acting in an axis perpendicular to the first clamping component, holds the edge piece against the side of the surface work piece.

Examples of such clamps are disclosed in U.S. Pat. No. 242,959 Naglee, and in U.S. Pat. No. 1,402,621 Knittel and Kesslering. However, certain problems are inherent in the clamps disclosed in the above patents. The first clamping component of each of these clamps includes two opposed coaxial clamping screws which provide a force for clamping in a first clamping axis. The second clamping component also includes a clamping screw. Application of the clamp to the work requires adjustment of all three clamping screws. Turning each clamping screw is a relatively slow process. Slow application of clamps to the working pieces is a particular problem in fabricating counter tops because long edge strips typically require many clamps to secure the edge strips until the adhesive sets. Typically, the adhesives used to bond the edge strips become tacky very rapidly, preventing realignment after a short time. Therefore, the time required to place and adjust each clamp is critical.

Other solutions, have been proposed to solve this problem with limited success. For example, the clamp disclosed in, U.S. Pat. No. 2,624,905, Hewat, uses only two clamping screws instead of three. However, in Hewat the clamping screw of the second clamping component is mounted to the side of the frame. This configuration results in clamping force being directed along a clamping axis which is beside the frame and out of a plane defined by the first clamping component. This causes torque about the frame which can cause the entire clamp to twist. Once the clamp twists, the second clamping component is directed at an angle to the work pieces. The twisting of the clamps is a particular problem because when the clamp twists, the edge piece will tend to slide on the adhesive. Any such sliding of the work pieces may cause disastrous results as the edge piece may become permanently adhered to the work piece in an incorrect position. The clamp U.S. Pat. No. 1,788,546 in Schmieder, suffers from the same problem due to its similar configuration.

The clamp disclosed in U.S. Pat. No. 4,957,257, Gonzalez, attempts to overcome both the problem of time consuming adjustment, and of twisting caused by a second clamping component acting outside the plane of the first clamping component. The speed at which the Gonzalez clamp may be applied is increased by allowing one arm of the first clamping component to slide into contact with the work piece before adjusting the threaded clamping component in the first clamping plane. Twisting is avoided by having the second clamping component act within the same plane as the first clamping component. However, installation and adjustment is still accomplished with threaded clamping components which must each be adjusted in a time consuming process in each clamping axis.

There are several other problems with the prior art dual-action clamps which have not been addressed. For example, the pressure exerted by the clamps must be constant even as the pieces may be drawn closer together as the adhesive dries. The pressure exerted by the threaded clamping components of the prior art clamps does not automatically adjust, and time consuming manual re-adjustment of the threaded clamping components may be necessary. Additionally, it is difficult to gage the pressure being exerted by the threaded clamping components of the prior art clamps. Consequently it is easy to exceed the maximum recommended clamping pressure for the materials on which the clamp is used, or to apply too little pressure, possibly causing damage to the materials or negatively effecting the appearance of the materials. For example, too much pressure may mar the surfaces of the material to which the clamps are applied, or may squeeze too much adhesive out of the joint between the work pieces, thereby weakening the joint. Too little pressure may leave a conspicuous glue line.

The present invention provides a solution to each of the problems discussed above, by providing a quick and easy to use clamp with clamping components acting within a single plane, having a spring force which is calibrated not to exceed the recommended clamping pressure for the materials on which the clamp is used, and which automatically adjust to provide a constant pressure even as the work pieces are drawn closer together as the adhesive dries.

SUMMARY OF THE INVENTION

According to the present invention, the dual-action clamp comprises a first clamping component acting in one axis in a plane defined by the first clamping component, and a second clamping component acting in the same plane on a second clamping axis.

The first clamping component comprises first and second gripping members coupled together for pivotal movement about a pivot pin between a gripping position and a releasing position. A force applying means is coupled to the pivot pin and to the gripping members for applying a closing force to the gripping members in a first axis. The force applying means is a spring, chosen for its specific spring resistance so that it urges the gripping members to clamp at a constant specific industry recommended pressure for the particular material on which the clamp will be applied. The first and second gripping members include first and second jaws and first and second lever arms, respectively. The lever arms extend from the jaws, with the jaws and lever arms positioned on opposite sides of the pivot pin. The force applying means includes a spring wrapped around the pivot pin and having first and second end extensions positioned to engage the first and second lever arms, respectively.

The second clamping component comprises a means for applying a force in an axis approximately perpendicular to the first clamping axis and substantially aligned with the centerline of the surface work piece. The second clamping component may comprise either a plunger and compression spring assembly or a tempered sheet metal spring assembly.

The invention further comprises a means for adapting any spring actuated plier type clamp having a first clamping component to add a second clamping component acting on an axis substantially perpendicular to the axis of the first clamping component and in the same plane as the first clamping component. Again, the second clamping component may comprise either a plunger and compression spring assembly or a tempered sheet metal spring assembly.

Although present invention has been describe in relation to clamps for use in holding work pieces which will be adhesively joined, such description should not be taken as a limitation of the invention. The clamp of the present invention may be used to hold pieces to be joined by any acceptable means, including screws, nails, and welding.

Accordingly, it is the general object of the present invention is to provide a dual-action clamp with both the first and second clamping components acting within the same plane so that twisting of the clamp will not occur.

Another object is to provide a dual-action clamp component which dynamically self adjusts to varying thicknesses of surface material thereby decreasing the amount of time taken to apply each clamp.

It is a further object of the invention to provide a dual action clamp which clamps at specific industry recommended pressure.

It is an additional object of the present invention to provide a dual-action clamp which will not mar the visible surfaces it touches.

It is a further object of the present invention to provide a dual action clamp which will self adjust as the glue dries, thereby maintaining the industry recommended clamping pressure, even as the pieces are drawn closer together.

It is another object of the present invention to provide a means for quickly and easily adapting existing spring clamps to obtain the objectives stated above.

Still other objects and advantages of the present invention will become readily apparent to those skilled in this art from the following detailed description, wherein I have shown and described the preferred embodiment by way of illustration of the best mode of the invention. Where appropriate, other embodiments have been discussed, however, still further alternate embodiments may be made without departing from the invention. Accordingly, the drawings and description, below, are to be regarded as illustrative in nature, and not as restrictive.

BRIEF DESCRIPTION OF THE DRAWINGS

A preferred embodiment of the present invention is further described in connection with the accompanying drawings, in which.

DETAILED DESCRIPTION

Reference will now be made in detail to a presently preferred embodiment of the invention as illustrated in the accompanying drawings. The drawings show a dual action clamp according to the present invention, indicated generally by reference number 10. Subsequent drawings show alternate embodiments of the invention which comprise an adaption to a conventional spring action plier type clamp indicated generally by referenced number 100. Although the following detailed description of clamps 10 and 100 relate to clamps for holding pieces which will be adhesively joined, such description should not be taken as a limitation of the invention. Clamps 10 and 100 described below may be used to hold pieces to be joined by any acceptable means, including screws, nails, and welding.

Figure 1:
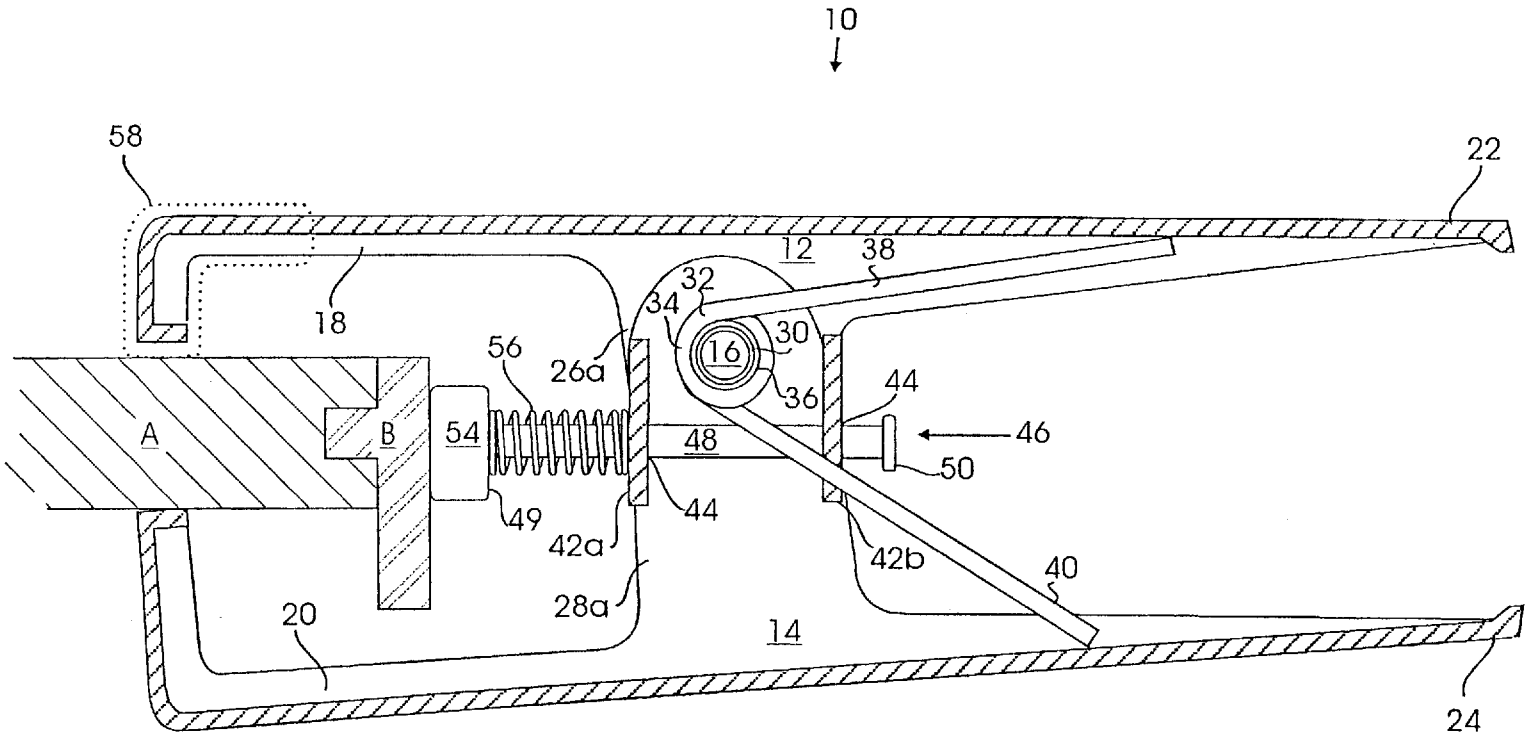
FIG. 1 is a sectional view of the dual-action clamp on sample work pieces.

Referring to FIG. 1, the dual-action clamp 10 of the present invention includes first and second gripping members 12 and 14 pivotally coupled to a pivot pin 16. The gripping members 12 and 14 include first and second gripping jaws 18 and 20 and first and second lever arms 22 and 24 extending from the jaws 18 and 20, respectively. In FIG. 1, gripping jaw 18 is shown shorter than gripping jaw 20. However, in alternative embodiments gripping jaws 18 and 20 may be of any length appropriate for the work pieces on which dual-action clamp 10 is designed for use.

A pair of pivot brackets 26*a* and 26*b* extend outward from gripping member 12, and substantially parallel to each other and a pair of pivot brackets 28*a* and 28*b* extend outward and substantially parallel to each other from gripping member 14. Pivot brackets 26*a*, 26*b*, 28*a*, and 28*b*, include pivot pin receiving apertures 30. As FIG. 1 is a sectional view, only brackets 26*a* and 28*a* are shown. Pivot brackets 26*a* and 26*b* are positioned to overlap pivot brackets 28*a* and 28*b* and align the pivot pin receiving apertures 30.

Dual-action clamp 10 further includes a force applying means in the form of a coiled spring 32 which includes a coiled portion 34 forming a tube 36 and first and second end extensions 38 and 40 projecting from the coiled portion 34. The coiled portion 34 is disposed between the pivot brackets 26*a* and 26*b* and 28*a* and 28*b* so as to align the interior of tube 36 with the apertures 30 in pivot brackets 26*a* and 26*b* and 28*a* and 28*b*. Pivot pin 16 extends between the apertures 30 and through the interior of tube 36 to hold the helically coiled spring 32 in position relative to gripping members 12 and 14. The spring extensions 38 and 40 project generally away from gripping jaws 18 and 20 and engage lever arms 22 and 24. The tension in the coiled spring 32 biases lever arms 22 and 24 apart, thereby urging gripping jaws 18 and 20 toward each other into the gripping position illustrated in the FIG. 1.

A pair of plunger brackets 42*a* and 42*b* extend outwardly and substantially parallel to each other from pivot bracket 28*a* and include plunger receiving apertures 44. A plunger generally indicated by number 46, having a shaft 48 and plunger head 54 is slideably received within plunger receiving apertures 44. Shaft 48 is coupled to plunger head 54 on one end. Plunger head 54 is formed having a diameter larger than shaft 48 thereby forming shoulder 49. The end of shaft 48 opposite plunger head 54 is formed with burr 50 in order to prevent shaft 48 from passing through plunger receiving apertures 44. Helical compression spring 56 engages, on one end, shoulder 49 of head 54, and plunger bracket 42*a* on the other end. Helical compression spring 56, because of its inherent spring tension, will tend to remain in contact with both shoulder 49 and plunger bracket 42*a* and therefore need not be coupled thereto. Plunger 46 is positioned so that when dual-action clamp 10 is engaged with the work pieces, plunger 46 is substantially aligned with the centerline of surface work piece A.

Elastomeric cover 58 is coupled to the end of gripping jaw 18. The elastomeric cover 58 is provided to prevent gripping jaw 18 from marring the upper surface of the work material held between gripping jaws 18 and 20. In alternate embodiments not shown, elastomeric covers may also be coupled to lever arms 22 and 24 to furnish a comfortable grip or to electrically insulate the lever arms. Although FIG. 1 shows only gripping jaw 18 having an elastomeric cover 58, in alternate embodiments, both gripping jaws 18 and 24 may have elastomeric covers coupled thereto. Head 54 of plunger 46 is composed of an elastomeric material. In alternative embodiments, not shown, head 54 is composed of other suitable material covered by an elastomeric material.

Figure 2:
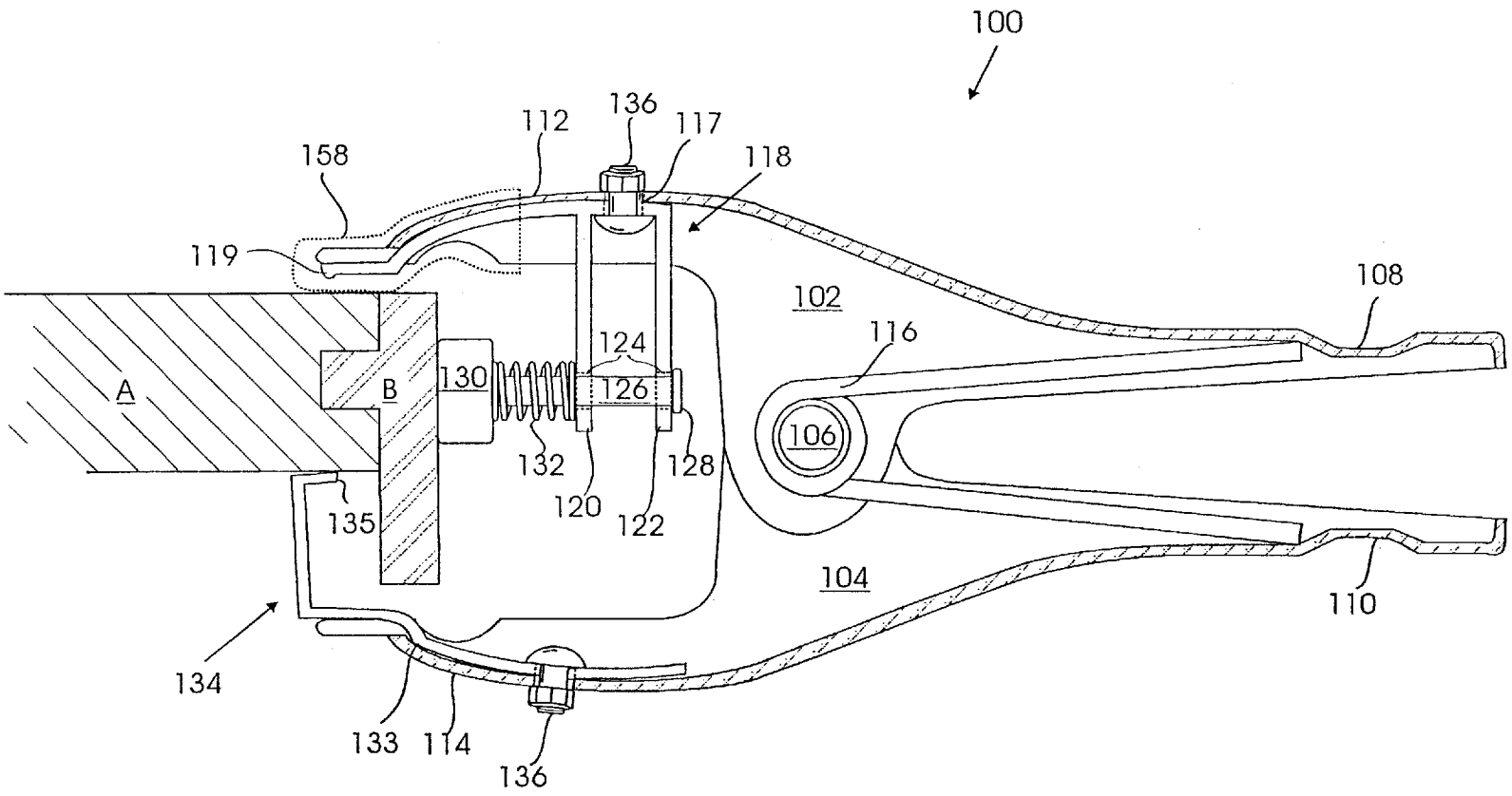
FIG. 2 is a sectional view of a standard spring action clamp with a second clamping component comprising a plunger assembly added on the first lever arm, and an extender on the second lever arm.

In an alternate embodiment, the invention is an adaption of a conventional spring actuated pliers-type clamp generally indicated by the number 100 as seen in FIG. 2. However, the invention is not limited to such adaption, the parts may be constructed and arranged specifically for the present purpose utilizing a clamp of some type other than a pliers-type clamp.

Referring to FIG. 2, the pliers type clamp 100 comprises a pair of lever arms 102 and 104 pivotally joined together intermediate their ends by a pivot pin 106. Lever arm 102 has a handle end 108 and a gripping jaw 112. Similarly, lever arm 104 has a handle end 110 and a gripping jaw 114. A coiled spring 116 urges handle ends 108 and 110 apart causing gripping jaws 112 and 114 to press against each other, or to press against opposite sides of a material placed between the gripping jaws 112 and 114 such as surface work piece A. Elastomeric covers may be used on any one or more of gripping jaws 112 and 114 or handle ends 108 and 110. In the embodiment shown in FIGS. 2, 3, 5, and 6, only the upper gripping jaw 112 is shown having an elastomeric cover 158.

According to the present invention, adaption of conventional spring pliers-type clamp 100 comprises a plunger bracket indicated generally by number 118 coupled to the interior side of gripping jaw 112 of clamp 100. The back member 117 of plunger bracket 118 is formed to fit within the curve of gripping jaw 112 of clamp 100, and includes lip 119 on the end of back member 117 nearest the tip of gripping jaw 112. In alternate embodiments not shown, plunger bracket 118 could be coupled to gripping jaw 114.

Arms 120 and 122 of plunger bracket 118 extend substantially parallel to the clamping axis of gripping jaws 112 and 114, and include plunger receiving apertures 124. Plunger 126, having a burred end 128, is slideably received within plunger receiving apertures 124. The end of plunger 126 opposite the burred end 128 has plunger head 130 coupled thereto. Helical compression spring 132 engages plunger head 130 on one end and arm 120 of plunger bracket 118 on the other. Helical compression spring 132, because of its inherent spring tension, will tend to remain in contact with both plunger head 130 and plunger bracket 120 and therefore need not be coupled thereto.

Lower jaw extender 134 is coupled to the interior side of gripping jaw 114. Lower jaw extender 134 includes a back portion 133 and an "L" shaped extension 135. Arms 120 and 122 and "L" shaped Extension 135 are formed of a length adequate, when clamp 100 is engaged on the work pieces, to align plunger 126 substantially along the centerline of surface work piece A.

The plunger bracket 118 and the lower jaw extender 134 are shown coupled to gripping jaws 112 and 114, respectively, by use of nuts and bolts 136, however, other acceptable means of coupling such parts may be used such as snaps, clips, adhesive, solder and welding.

Figure 3:
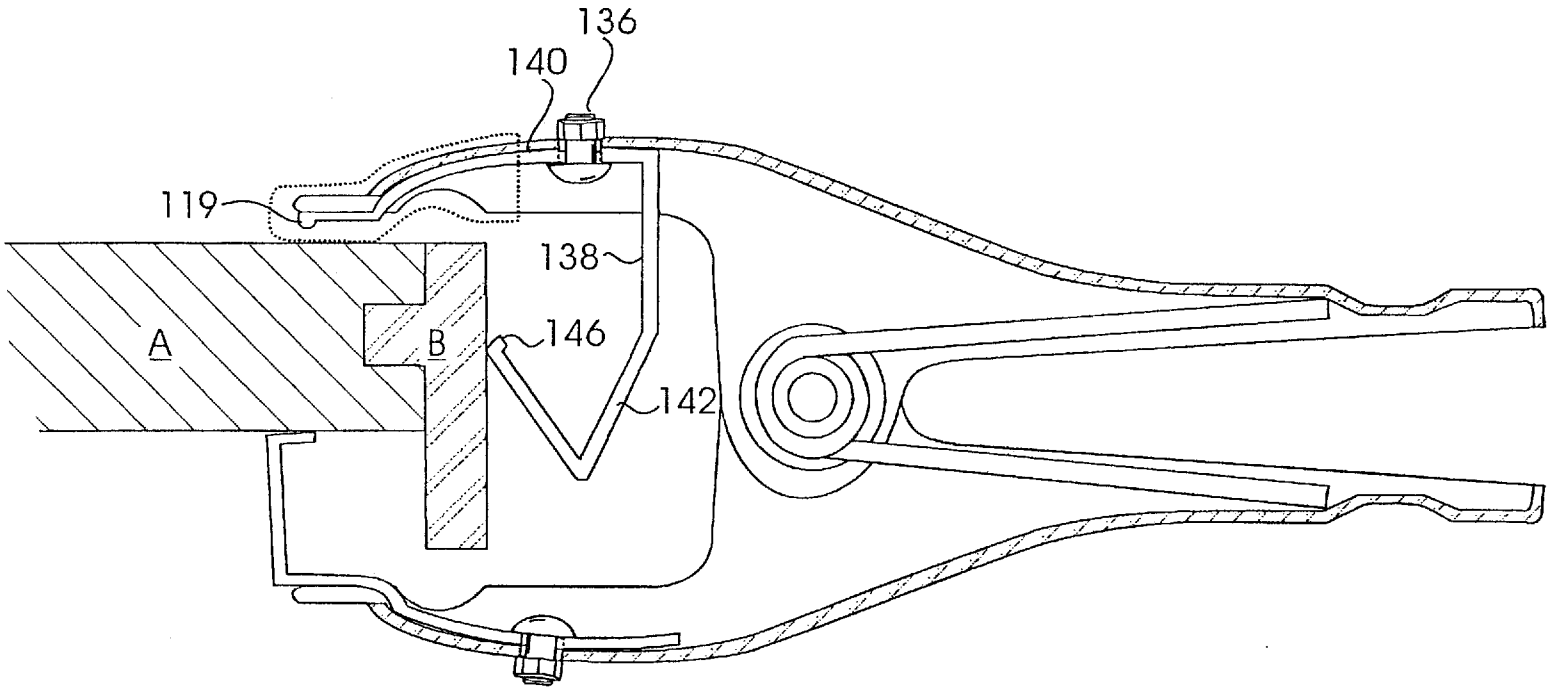
FIG. 3 is a sectional view of another embodiment of a standard spring action clamp adapted as in FIG. 2, but with the second clamping component comprising a tempered sheet metal spring.

In an alternative embodiment, best seen in FIG. 3, a tempered sheet metal spring 138 is used instead of the plunger bracket 118 seen in FIG. 2. Tempered sheet metal spring 138 includes spring back portion 140, lip 119, spring loop 142, and contact point 146. Tempered sheet metal spring 138 is position so that contact point 146 pushes against edge work piece B at a point which is substantially aligned with the centerline of edge work piece A. In an embodiment not shown, contact point 146 of Tempered sheet metal spring 138 may be covered by an elastomeric material.

Figure 4:
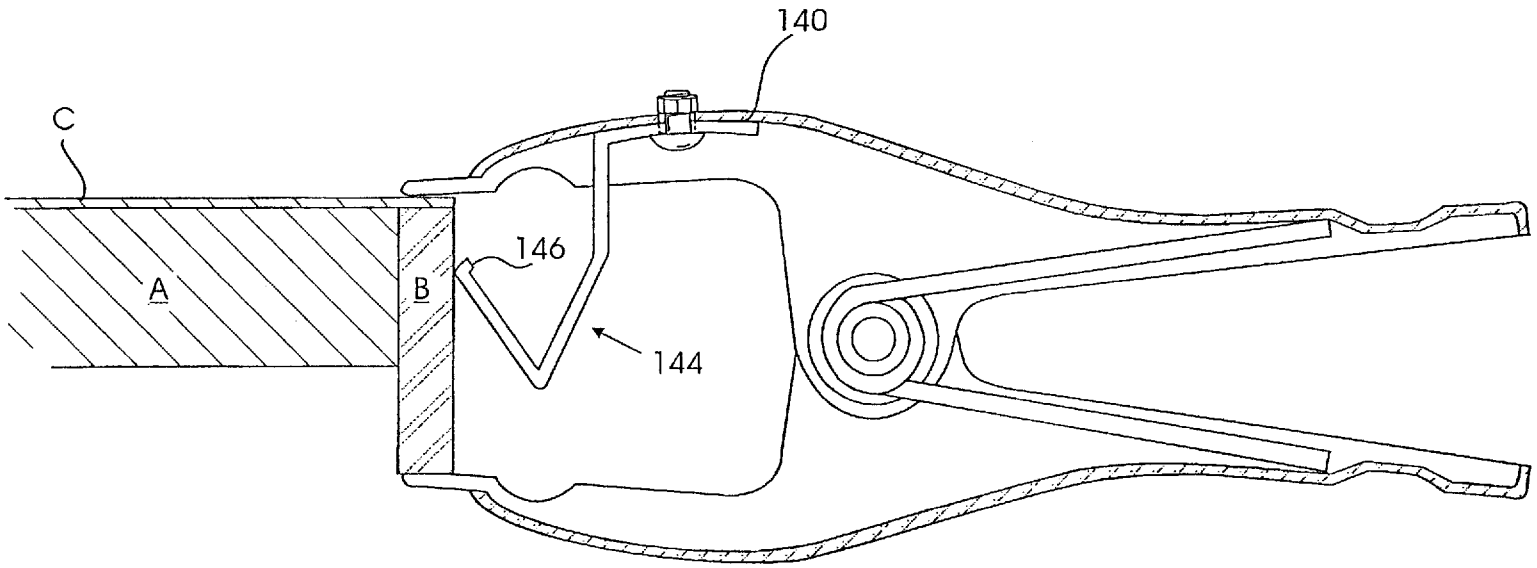
FIG. 4 is a sectional view of another embodiment of the second clamping component comprised of a tempered sheet metal spring.

In FIG. 4, an alternate embodiment of the tempered sheet metal spring, generally referenced by the number 144, is used. In this embodiment, spring back portion 140 is oriented in the opposite direction and does not include a lip 119. In the embodiment shown in FIG. 4, no lower jaw extender 134 is used on gripping jaw 114. This embodiment is meant for use to hold an edge piece B against a solid surface piece A which has an overlapping laminate surface C, as shown in FIG. 4.

In the embodiments described, the clamps 10 and 100 are constructed of light weight metal and spring steel. However, in alternate embodiments, any acceptable materials may be used.

Referring to FIG. 1, in order to apply dual-action clamp 10, lever arms 22 and 24 are squeezed together to allow the gripping jaws 18 and 20 to be positioned on opposite sides of the work piece materials. Dual-action clamp 10 is pushed inward until head 52 of plunger 46 contacts the work material and compresses helical compression spring 56 thereby applying force to the edge piece urging the edge piece B against the surface piece A.

Similarly, referring to FIG. 2, 3, 4, 5 and 6, in order to apply the adapted spring-actuated plier type clamp 100, gripping jaws 112 and 114 are separated by squeezing lever arms 102 and 104 towards each other to allow gripping jaws 112 and 114 to be positioned on opposite sides of the surface work piece A.

Figure 5:
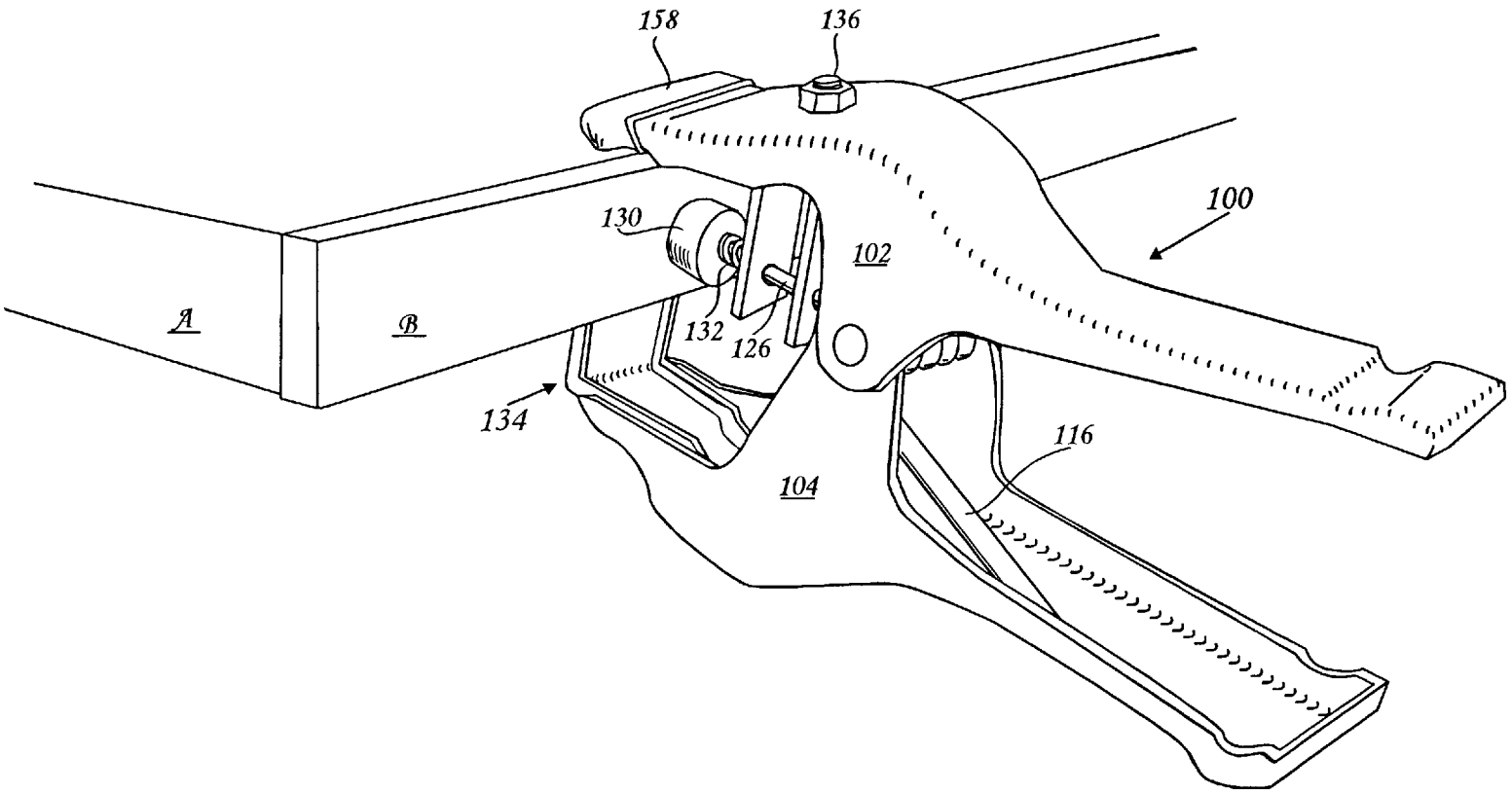
FIG. 5 is a perspective view of the standard spring action clamp adapted as in FIG. 2
Figure 6:
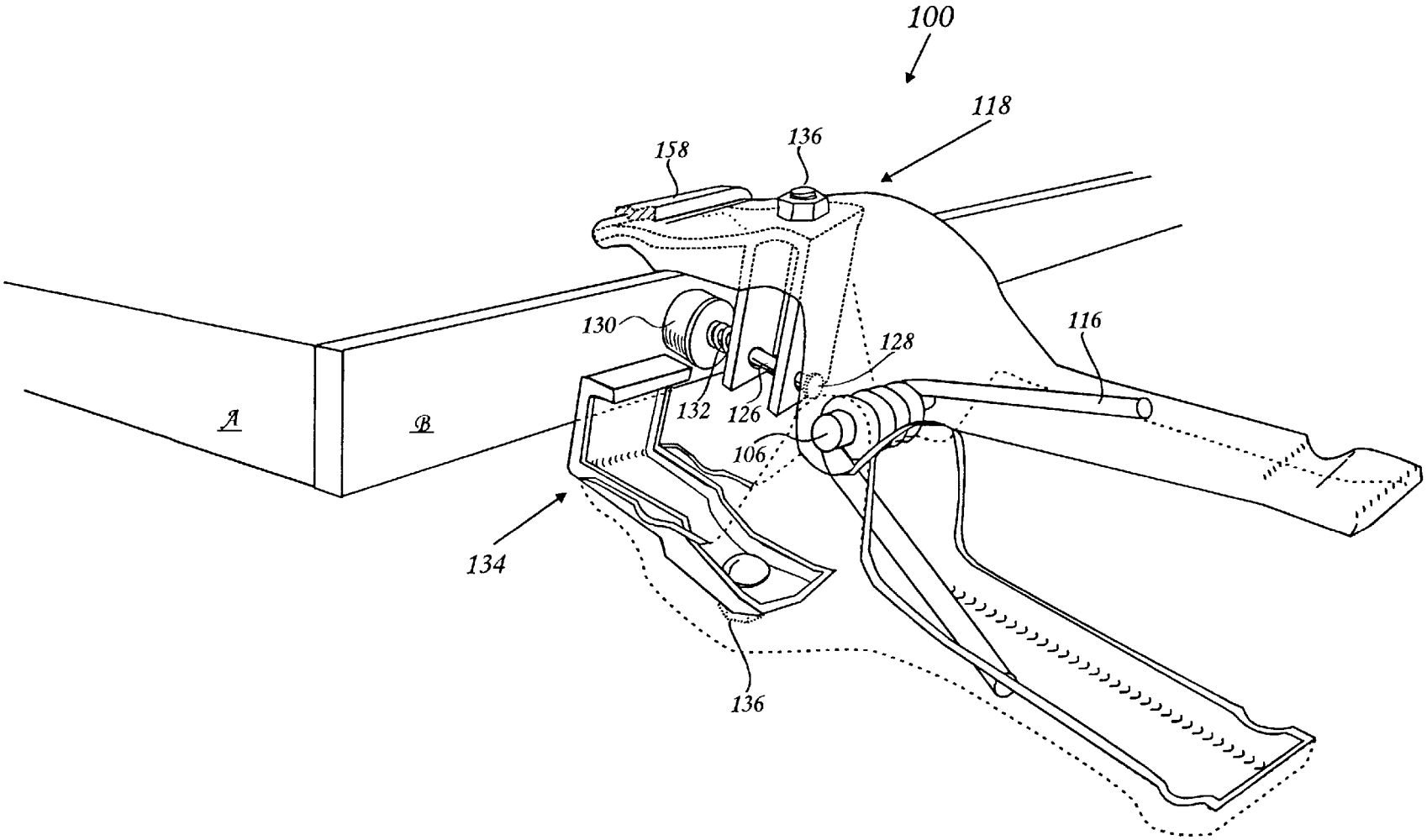
FIG. 6 is a cut-away perspective view of the clamp in FIG. 2 exposing the second clamping component and the arm extender.

In the dual-action clamp embodiments using a plunger, best seen in FIGS. 2, 5, and 6, dual-action clamp 100 is pushed inward until head 130 of plunger contacts the work material compressing helical compression spring 132, thereby applying force to edge work piece B urging it against the solid surface work piece A. In the dual-action clamp embodiments using a tempered sheet metal spring 138 or 144, best seen in FIGS. 3 and 4, dual-action clamp 100 is pushed inward until contact point 146 of tempered sheet metal spring 138 or 144 contacts the work material, thereby applying force to edge work piece B urging edge piece B against the surface work piece A.

The spring assemblies automatically adjust to the work pieces, therefore application of either dual-action clamp 10 and 100 is quick and efficient.

Preferably, the dual-action clamps 10 or 100 will have known spring forces acting in each clamping axis, which spring forces are chosen to meet the industry recommended clamping pressure for the work pieces on which the dual-action clamps 10 or 100 are to be used.

The lower jaw extender 134 of the second embodiment, best seen in FIGS. 2 and 3, may be used where the edge work piece B extends beyond the lower surface of solid surface work piece A, and where such extender is required to align the axis of the second clamping component substantially along the centerline of surface work piece A.

While the above description contains many specificities, the examples given should not be construed as limitations on the scope of the invention, but merely exemplifications of preferred embodiments thereof. Additional advantages and modifications will readily occur to those skilled in the art. The invention in its broader aspects is therefore not limited to the specific details, representative apparatus and illustrative examples shown and described. Accordingly it should be apparent to those skilled in the art that variations and modifications are possible without departing from the spirit of the invention.

What is claimed is:

1. A clamp comprising:

a first clamping means including a first arm and a second arm defining a plane and presenting a first clamping force along a first clamping axis in said plane, and a means for moving said first arm and said second arm relative to each other within said plane; and a second clamping means, presenting a second clamping force along a second clamping axis, said second clamping axis being substantially perpendicular to said first clamping axis; and, means for attaching said second clamping means to said first clamping means so that said second clamping axis is in said plane of said first clamping axis.

2. The clamp of claim 1 wherein said second clamping means comprises a plunger and a compression spring.

3. The clamp of claim 1 wherein said second clamping means comprises a tempered sheet metal spring.

4. The clamp of claim 1 wherein said first and second arms of said first clamping means comprise a first and a second lever arm, said lever arms each having a gripping jaw end and a handle end, each said first and second lever arms having a pivot point intermediate between said gripping jaw end and said handle end, said first and second lever arms being pivotally coupled at said pivot point; and a force generating means coupled to said handle end of said first lever arm and to said handle end of said second lever arm;

whereby, said force generating means urges said handle ends of said first and second lever arms apart causing said gripping jaw end of said first lever arm and said gripping jaw end of said second lever arm press to against each other, or against the material placed between said gripping jaw ends.

5. The clamp of claim 4 wherein said second clamping means comprises a plunger and a compression spring, said compression spring acting on said plunger to urge said plunger against the work piece in an axis substantially perpendicular to said axis of said first clamping means.

6. The clamp of claim 4 wherein said second clamping means comprises a tempered sheet metal spring, said tempered sheet metal spring acting directly on the work piece in an axis substantially perpendicular to said axis of said first clamping means.

7. The clamp of claim 4 wherein said second gripping jaw end includes a means for extending said second gripping jaw end.

8. The clamp of claim 1, wherein said second clamping means is selected from the group consisting of:

a compression spring;

a torsion spring; and a helical compression spring.

9. A clamp comprising:

a first clamping means including a first and a second lever arm defining a plane and presenting a clamping force along a first clamping axis in said plane, said first lever arm having a first gripping jaw end and a first handle end, and said second lever arm having a second gripping jaw end and a second handle end, said lever arms each having a pivot point intermediate between said gripping jaw end and said handle end, said first and second lever arms being pivotally coupled at said pivot point; and a means for urging said handle ends of each said first and second lever arms apart thereby urging said gripping jaw ends of each of said first and second lever arms together; and a second clamping means, presenting a second clamping force along a second clamping axis coupled to said first gripping jaw end of said first lever arm, said second clamping axis being substantially perpendicular to said first clamping axis; and means for attaching said second clamping means to said first clamping means so that said second clamping axis is in said plane of said first clamping axis; and a jaw extender coupled to said second gripping jaw end of said second lever arm.

10. The clamp of claim 9 wherein said second clamping means comprises a plunger and a compression spring, said compression spring acting on said plunger to urge said plunger against the work piece.

11. The clamp of claim 9 wherein said second clamping means comprises a tempered sheet metal spring, said tempered sheet metal spring acting directly on the work piece.

12. The clamp of claim 9 wherein said second clamping means comprises a plunger and a compression spring, said compression spring acting on said plunger to urge said plunger against the work piece, and said second clamping axis being substantially perpendicular to said first clamping axis.

13. The clamp of claim 9 wherein said second clamping means comprises a tempered sheet metal spring, said tempered sheet metal spring acting directly on the work piece, and said second clamping axis being substantially perpendicular to said first clamping axis.

* * * * *